US005443270A

United States Patent [19]

Loritz

[11] Patent Number: 5,443,270

[45] Date of Patent: Aug. 22, 1995

[54] GAME PIECE FOR PLAYING MILK CAP OR POGS

[76] Inventor: Steven R. Loritz, 245 N. Singingwood, Orange, Calif. 92669

[21] Appl. No.: 195,040

[22] Filed: Feb. 14, 1994

[51] Int. Cl.[6] ..... A63F 7/00; A63B 65/10; A63B 67/06

[52] U.S. Cl. ..... 273/290; 273/424; 273/DIG. 1; 273/DIG. 4; 273/DIG. 7; 273/DIG. 12; 40/27.5

[58] Field of Search ..... 273/288, 290, DIG. 4, 273/DIG. 12, DIG. 27, 288, 290, 353, 393, 424; 40/27.5

[56] References Cited

U.S. PATENT DOCUMENTS 1,935,308 11/1933 Baltzley ..... 273/148 R
2,429,020 10/1947 Friedman ..... 40/27.5
4,325,556 4/1982 DeCanto et al. ..... 40/27.5
5,340,113 8/1994 Respicio ..... 273/249

*Primary Examiner*—Benjamin H. Layno
*Attorney, Agent, or Firm*—G. Donald Weber, Jr.

[57] ABSTRACT

A disc which is used as a game piece for playing a game known as "Milk Caps"or "POGS". At least one side of the disc is decorated. The disc makes a metallic sound when it is dropped, thrown or slammed against a solid playing surface. The disc is preferably made of a strong plastic such as polyphenlene sulfide which prevents the disc from shattering. The disc may have an annular lip along its edge which facilitates manufacturing. The edge of the disc may be sloped or angled wherein the bottom portion of the disc has a slightly larger diameter than the top portion of the disc. This also facilitates manufacturing.

10 Claims, 1 Drawing Sheet

GAME PIECE FOR PLAYING MILK CAP OR POGS

BACKGROUND

1. Field of the Invention

This invention relates to a game piece, in general, and, more specifically, to a game piece having particular characteristics, as well as the method of making these game pieces.

2. Prior Art

As a consequence of the rapidly growing phenomena related to the collection of various forms of memorabilia and, especially, trading cards, an entire new industry has developed. The trading card industry, initially fueled by the rise in popularity of collecting baseball cards, now comprises not only baseball cards, but also football, basketball, and hockey cards, as well as many other nonathletic oriented areas such as cartoon characters, celebrities, and the like. The escalation in the value of many collectibles, led by the escalation in the value of baseball cards, has generated a great interest in a number of new collectible areas and has rekindled interest in some long-dormant collectibles. The collection of milk bottle caps or juice bottle caps for hobby and profit has once again become a very popular activity. Many manufacturers of milk and juice bottle caps have become hard-pressed to keep up with the demand for these collectibles. One major contributing factor to the great popularity of bottle cap collecting among children and adults is the resurgence of a game known by various names, most commonly "The Milk Cap Game".

In the game of "Milk Caps" or as it is now popularly referred to, "POGS" a stack of bottle caps (or game pieces) is , placed on a flat, solid surface, usually the floor, but, alternatively, the sidewalk, playground, street, or the like. Each player takes turns "slamming" a heavier or weighted cap down on top of the stack. The goal of playing "POGS" is to dislodge and flip over as many of the stacked caps as possible. Typically, the caps which are turned over are captured or won by the successful participant.

The game of POGS, as with the ageless game of marbles, involves the development of certain skills which, when refined, result in players being rewarded by being able to capture an increased number of valuable caps.

The game of "POGS" has become so popular in certain parts of the country that it has replaced many traditional "street games". For example, "POGS" tournaments are held throughout the Hawaiian Islands, especially on the island of Oahu, and this activity is rapidly expanding to the United States mainland.

The game pieces are often collected for their own intrinsic value. Thus, the game pieces can have unique manufacturing processes, decorative trim, and distinct sizes and weights, among other desirable (and collectible) attributes.

SUMMARY OF THE INSTANT INVENTION

This invention provides an improved game piece and a method of making same. The game piece has a number of advantages including strength, a metallic ringing sound (when flipped) and easy fabrication techniques. The game piece is readily decorated on at least one surface thereof.

DESCRIPTION OF A PREFERRED EMBODIMENT

Figure 1:
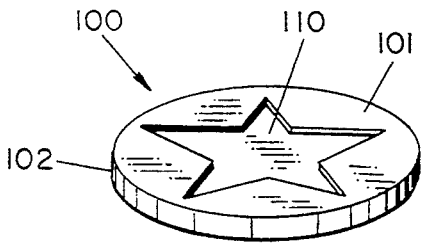
FIG. 1 is a top perspective view of a preferred embodiment of the instant invention.
Figure 2:
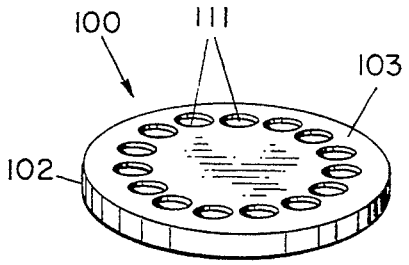
FIG. 2 is a bottom perspective view of a preferred embodiment of the instant invention.

Referring now to FIGS. 1 and 2, there are shown perspective top and bottom views, respectively, of the disk which forms the instant invention. In particular, FIG. 1 shows the top plan view of the disc 100 with the upper surface 101 and an edge or peripheral surface 102. A suitable decorative design 110 is depicted on upper surface 100.

FIG. 2 shows the lower surface 103 intersection with the peripheral surface 102. One or more markings 111 are shown on surface 102.

In FIG. 1, the decorative design 110 is shown as a starburst or the like. Any other type of design, alpha numeric representation, pattern or the like can be provided.

Likewise, on the bottom or reverse surface 103, there are shown a plurality of circular indentations 111. These indentations are relatively shallow and can take any number of forms and/or configurations. The indentations 111 can be arranged in any prescribed pattern, configuration and number, as well as different sizes and the like.

The decorative portion 110 is primarily esthetically pleasing to the user. Alternatively, the decoration 110 can be an advertising slogan; a personalized logo; an abstract pattern; or any other type of decoration so desired. As will be apparent, the decoration can be of any color; it can be in the form of a Mylar film or foil which is applied to the disc 100; it can be silk-screened; it can be painted; or applied in any suitable or desirable fashion. In the preferred embodiment, the decoration 110 is provided in the form of a thin Mylar film or foil which is hot-stamped or heat transferred onto the disc.

As shown in FIG. 2, the pattern of indentations 111 on the bottom surface 103 can be a plurality of circles, ellipses or any other geometric configuration. Alternatively, the pattern of indentations 111 can be a plurality of grooves or the like. The major purpose of the pattern 111 is to establish a certain "roughness" to the underside of the disc so that it can be deployed by the user without slippage.

Typically, the discs 100 are very short cylinders or wafers, as suggested. Typically, the discs of this invention are on the order of 1.6 to 1.8 inches in diameter with a thickness of 0.05 to 0.29 inches. While these dimensions are preferred, they are not absolutely limitative of the instant invention.

In addition, the disc 100 can be fabricated of many types of materials. Such materials are plastic, metal, wood, cardboard or the like. In the preferred embodiment, the discs are made of a plastic material. The plastic materials which can be used are any of the engineering resins such as, but not limited to, polyolefin, polyethylene and polypropylene. The preferred materials are polycarbonate or polyphenylene sulfide. The plastic material can be pure, i.e. "unfilled" or, in the alternative, it can be "filled" with glass or minerals.

The preferred construction is the polyphenylene sulfide with a certain amount of glass bead filling. This produces a disc which is very strong and will not shatter. The polyphenylene sulfide is used because of the high specific gravity thereof, i.e. on the order of 1.3 (unfilled) and 1.9 (glass filled). Typically, discs of this material cannot be broken (by hand) when a thickness of at least 0.09 inches is achieved.

Moreover, the disc 100 of the instant invention produces a very definite metallic sound when it is dropped, thrown, or slammed against a solid playing surface.

Figure 3:
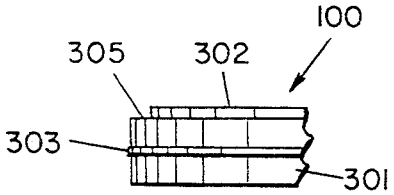
FIG. 3 is a fragmentary elevational view of one embodiment of the instant invention.

Referring now to FIG. 3, there is shown a fragmentary elevational view of one embodiment of the instant invention. In this embodiment, the disc 100 includes the body 301 and the decorative layer 302. The body 301 is equivalent to the disc, per se. The decorative layer 302 is equivalent to the decoration 110, shown in FIG. 1. This decorative layer is, generally, quite thin, for example, on the order of 0.0005. In addition, an annular lip 303 is provided around the periphery of the lip. This lip is on the order of 0.01 through 0.04 inches wide and approximately 0.001–0.005 inches larger than the diameter of the disc 100. This lip (or shoulder) permits the disc 100 to be pulled into the ejector side of the injection mold apparatus (described hereinafter). That is, without the shoulder 303, any deep engraving or artwork that might be included in the decorative portion 302 could cause the disc 100 to hang up in the wrong portion of the mold. Typically, without the lip, any engraved artwork of more than 5% of the total surface area would prevent the disc from being separated properly from the mold.

Also, as shown in FIG. 3, an outside border 305 can be provided. The border (or groove) is, typically, on the order of 0.030 to 0.080 inches wide and 0.005 to 0.050 inches deep. This border is provided to prevent any burrs from being formed along the outside of the disc 100. In addition, the border can permit easier decorating by providing a negative surface of the type shown and described infra.

Figure 4:
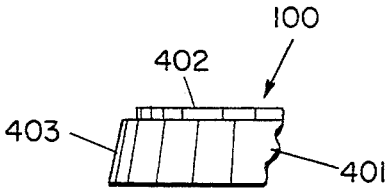
FIG. 4 is a fragmentary elevational view of another embodiment of the instant invention.

Referring now to FIG. 4, there is shown an alternative embodiment. Again, the disc 100 includes the body 401 and the decorative surface 402. In this case, however, the peripheral surface 403 of the disc is angled slightly to facilitate the removal of the disc from the mold. In this case, the larger diameter (or bottom) portion of the disk is on the order of 0.003 to 0.005 inches larger than the smaller diameter (or top) of the disc 100. This "reverse draft angle" on the peripheral surface of the disc 100 also allows the disc 100 to be pulled into the injector mold half. It allows for even deeper engravings in the decorative layer 402. This angled configuration is better used when the artwork surface is in excess of 25% of the surface area of the disc 100.

Figure 5:
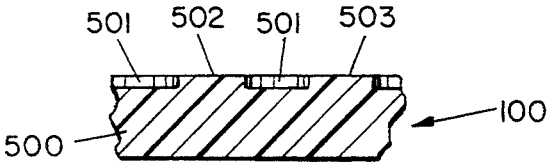
FIG. 5 is a fragmentary cross-sectional view of one embodiment of the instant invention.

Referring now to FIG. 5, there is shown a cross-sectional view of a typical disc fabricated in accordance with the instant invention. In this case, the disc 100 includes artwork areas 502 and 503 which are raised above the surface 501 of the body 500. The raised areas 502 and 503 are considered the positive artwork area. Conversely, the lower artwork areas 501 are considered to be the negative artwork areas. This type of surface permits a decorative finish to be applied to the upper surface of body 500. Typically, the decorative finish is applied to the positive or raised sections such as 502 and 503.

As noted, the decorative finish can be applied by hot stamp, foil, ink, paint or the like. In the typical process, the decorative portion covers the entire surface of the raised areas 502, 503 and so forth. The detented surface 501 is untouched and remains the color of the original plastic material of the body 500 of the disc 100. In most cases, the body 500 is black, but this is not a requirement.

This arrangement provides for an artwork process referred to as "tipping" which permits a finer degree of artwork detail.

Figure 6:
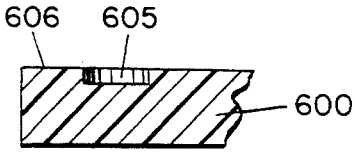
FIG. 6 is a fragmentary cross-sectional view of another embodiment of the instant invention.

Referring now to FIG. 6, there is shown an inside border 605 which is defined in the upper surface of the body 600 which is similar to the body 500 shown in FIG. 5. Again, the interior border 605 renders the decoration of the disc 100 somewhat easier. In addition, the inside border (or groove) prevents the outer edge 606 of the disc from sinking or drooping.

Figure 7:
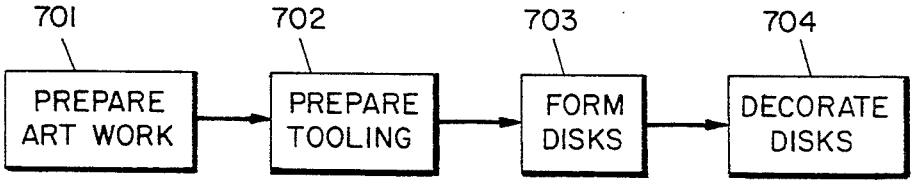
FIG. 7 is a block diagram of the process of making the devices of the instant invention.

Referring now to FIG. 7, there is shown a schematic representation of the manufacturing process for producing the discs of the instant invention.

In step 701, the artwork is prepared. This is typically the preparation of the decorative material 110 shown in FIG. 1. That is, the artwork is typically engraved into an electrode material, such as, but not limited to, graphite. This artwork can be formed through engraving in the graphite. This operation can be computer controlled, manually performed or the like.

In step 702, the graphite electrode is then used in the manufacturing of the metal mold (or tool) which is used to fabricate the discs. The mold is engraved in step 702 which comprises an electronic discharge machining (EDM) process. In this case, the tooling is fabricated to have the reverse or mirror image of the decorative material 110 formed therein. It is possible to provide a SPI-SPE number to the mold finish when the mold (typically stainless steel) is fabricated from the electrode. A #2, #3, #4 or #5 finish is also achievable during the EDM process. This finish permits the hot stamp foil to adhere better to the disc.

In step 703, the tool is then mounted in a conventional plastic injection molding machine (PIM). The PIM may have one or multiple cavities for receiving one or more of the engraved tools made in step 702. The engraved tools, the mold, and the PIM are arranged to produce the discs 100. The PIM operates with the appropriate pressure, temperature and time duration (as determined by the materials used) to form the discs 100. The PIM machines, in the conventional manner, include the ejector portion of the mold. When the mold is separated, the ejector portion tends to eject the disc therefrom. The manufacturing techniques shown and described supra aid and abet the PIM in ejecting the discs cleanly and efficiently from the mold.

The discs 100 are then decorated in step 704. The discs 100 are placed in a suitable machine or apparatus to permit the hot stamping, painting, inking or the like to establish the preferred decorative surface.

As noted, this surface can be any number of designs, colors, materials or the like.

When the process is completed, a disc such as shown in FIGS. 1 and 2 is provided. By using the material shown and described above, the disc 100 is quite strong and will not shatter. It is decorated in accordance with appropriate designs on one or both surfaces. Typically, at least one surface has a gripping pattern thereon to enhance the manipulation thereof by the operator. The discs 100, in addition to all the above, tend to have a metallic sound or ring when dropped. These discs are arranged to be approximately the same size as the original milk bottle caps which were originally used in the POGS game.

Thus, there is shown and described a unique design and concept of a game piece and method of making same. The particular configuration shown and described herein relates to game pieces (POGS, poker chips or the like) which are decorated on at least one surface thereof. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A disc comprising, a thin wafer formed of a plastic material for use in a game, said wafer having upper and lower surfaces which are substantially parallel to each other, at least a portion of at least one of said upper and lower surfaces is raised to produce a design, a groove formed in at least one of said upper and lower surfaces, and an edge surface intermediate said upper and lower surfaces of said wafer, said plastic material is polyphenlene sulfide.

2. The disc recited in claim 1 wherein, said plastic is glass-filled polyphenylene sulfide.

3. The disc recited in claim 1 wherein, said groove is formed in said upper surface.

4. The disc recited in claim 3 wherein, said groove is formed immediately adjacent to said edge surface.

5. The disc recited in claim 3 wherein, said groove is formed spaced away from said edge surface.

6. The disc recited in claim 1 wherein, said upper surface includes a decorative design, and said lower surface includes a pattern to establish roughness.

7. The disc recited in claim 6 wherein, said design can be of any color.

8. The disc recited in claim 6 wherein, said design can be formed of Mylar.

9. A disc comprising, a thin wafer formed of a plastic material for use in a game, said wafer having upper and lower surfaces which are substantially parallel to each other, at least a portion of at least one of said upper and lower surfaces is raised to produce a design, a groove formed in at least one of said upper and lower surfaces, and an edge surface, said edge surface is sloped from a slightly larger diameter lower surface to a slightly smaller diameter upper surface.

10. A disc comprising, a thin wafer formed of a plastic material for use in a game, said wafer having upper and lower surfaces which are substantially parallel to each other, at least a portion of at least one of said upper and lower surfaces is raised to produce a design, a groove formed in at least one of said upper and lower surfaces, and an edge surface, said edge surface includes an annular lip formed thereon between said upper and lower surfaces.

* * * * *